US009265329B1

(12) United States Patent
Küllenburg

(10) Patent No.: US 9,265,329 B1
(45) Date of Patent: Feb. 23, 2016

(54) HAMMOCK

(71) Applicant: Joachim Küllenburg, Groβkarolinenfeld (DE)

(72) Inventor: Joachim Küllenburg, Groβkarolinenfeld (DE)

( * ) Notice: Subject to any disclaimer, the term of this patent is extended or adjusted under 35 U.S.C. 154(b) by 0 days.

(21) Appl. No.: 14/803,073

(22) Filed: Jul. 19, 2015

(30) Foreign Application Priority Data

Jul. 29, 2014 (DE) ..... 20 2014 103 523 U

(51) Int. Cl.
*A45F 3/22* (2006.01)
*A45F 3/24* (2006.01)

(52) U.S. Cl.
CPC .... *A45F 3/22* (2013.01); *A45F 3/24* (2013.01)

(58) Field of Classification Search
CPC ..... A45F 3/22; A45F 3/24; A47C 17/84
USPC ..... 5/122, 120, 127
See application file for complete search history.

(56) References Cited

U.S. PATENT DOCUMENTS

| | | | | | |
|---|---|---|---|---|---|
| 1,515,263 | A | * | 11/1924 | Matsusaki | 5/120 |
| 2,355,635 | A | * | 8/1944 | Dubilier | 139/420 R |
| 2,372,632 | A | * | 3/1945 | Webb | 428/104 |
| 3,010,114 | A | * | 11/1961 | Lipschultz | 428/103 |
| 4,221,424 | A | * | 9/1980 | Eiserman et al. | 296/152 |
| 4,593,418 | A | * | 6/1986 | Simon | 2/275 |
| 4,637,330 | A | * | 1/1987 | Shewmon | 112/417 |
| 6,155,647 | A | * | 12/2000 | Albecker, III | 297/452.16 |
| 6,701,549 | B1 | * | 3/2004 | Eriksen | 5/120 |
| 7,178,182 | B2 | * | 2/2007 | Brenner et al. | 5/413 R |
| 7,627,913 | B2 | * | 12/2009 | Clark | 5/120 |
| 2006/0185085 | A1 | * | 8/2006 | Brenner et al. | 5/413 R |
| 2009/0265851 | A1 | * | 10/2009 | Clark | 5/122 |
| 2011/0315180 | A1 | * | 12/2011 | Kanayama | 135/115 |

* cited by examiner

*Primary Examiner* — Robert G Santos
(74) *Attorney, Agent, or Firm* — Smartpat PLC

(57) ABSTRACT

A hammock without spreader bars comprises a plurality of fabric panels. The fabric panels consist of cutout sections of a micromesh fabric of substantially biconvex form, which are attached to one another at their edges to form a bed. The biconvex fabric panels are joined, preferably sewn, to one another in a pretensioning position along the line at which the individual sections of fabric are joined, whereby in its suspended state the bed of the hammock is substantially open, i.e. laterally extended.

5 Claims, 2 Drawing Sheets

HAMMOCK

TECHNICAL FIELD

The present disclosure relates to a hammock without spreader bars having a bed comprising panels of fabric arranged along the longitudinal axis of the hammock, and which can be suspended by suspension elements between two anchor points.

BACKGROUND

Hammocks without spreader bars are commonly known. They are usually made of woven cotton panels, or knotted from cotton in the form of a net, and attached to suspension points at both ends by means of woven cotton loops or an interwoven cord.

Hammocks without spreader bars are normally very soft, unstable, and therefore collapse narrowly in upon themselves when not in use. The fabric also tends to envelop the reclining occupant when in use, thus a slightly diagonal position is usually chosen in order to manually spread apart the hammock. As hammocks without spreader bars do not have stable forms, the reclining occupant's body assumes a curved position.

A further drawback of known hammocks relates to the cotton material used, which is highly sensitive to rain, salt, water, and sun, and which promotes the formation of mildew spots, material wear, and the transfer of dye from the fabric to objects with which it comes into contact.

SUMMARY

The present disclosure provides a hammock without spreader bars which overcomes the drawbacks stated above. The novel hammock is completely weatherproof, and has an open bed of the kind previously found only in hammocks with spreader bars.

The novel hammock comprises a plurality of fabric panels. The fabric panels consist of cutout sections of a micromesh fabric of substantially biconvex form, which are attached to one another at their edges to form a bed.

Biconvex is herein understood to mean panels of fabric which are shaped or cut so as to be outwardly convex on both sides. These biconvex fabric panels (fabric strips) are joined to one another (preferably sewn) such that a pretensioning (warp) is created along the line at which the individual sections of fabric are joined, which has the effect that, in its suspended state, the bed of the hammock is substantially flat or at least open, i.e. laterally extended.

The material used to manufacture the biconvex fabric panels is preferably high-quality, PVC-coated micromesh fabric that is tear- and abrasion-resistant, that permanently retains its shape and color, and which is UV-resistant.

DETAILED DESCRIPTION

Figure 1:
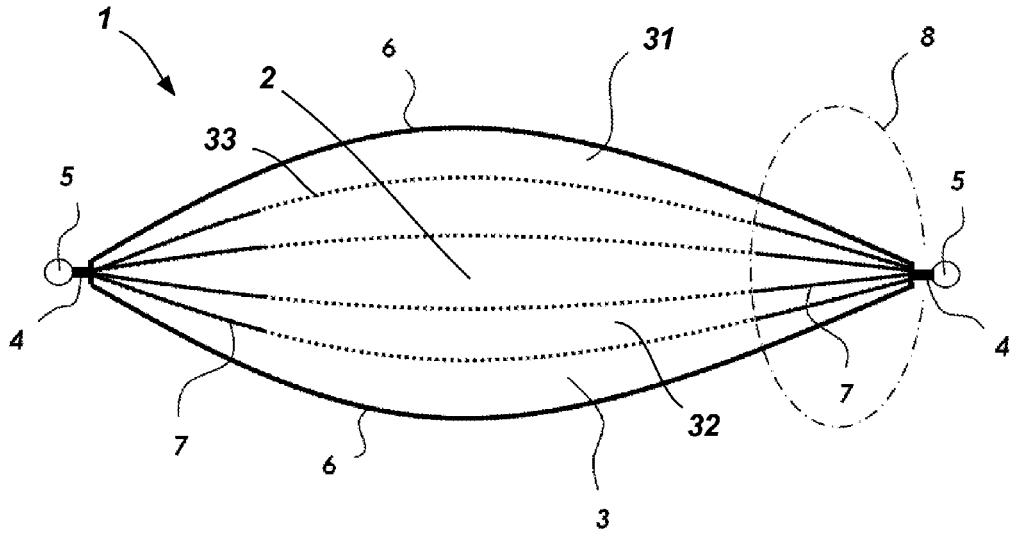
FIG. 1 is a schematic top view of a hammock.
Figure 2:
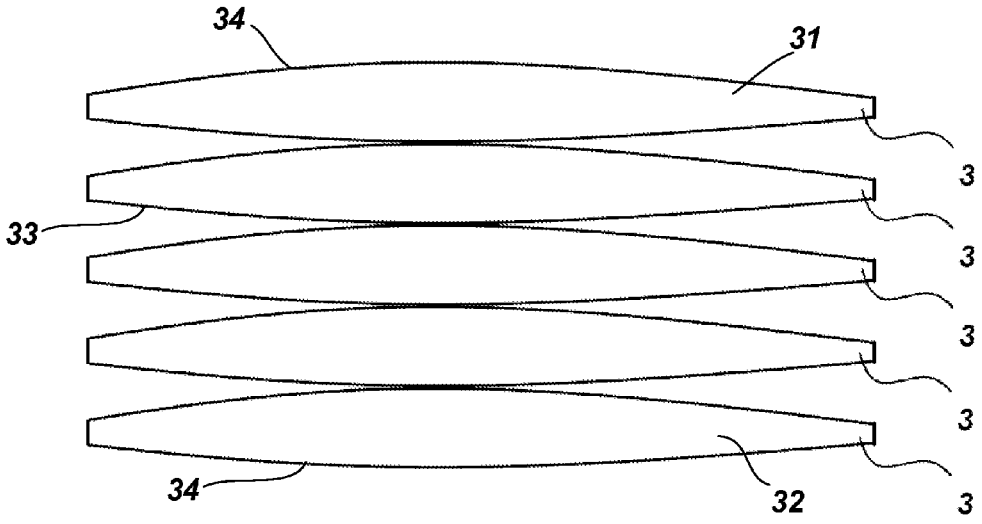
FIG. 2 is a top view showing individual fabric panels used in the hammock of FIG. 1.

FIG. 1 shows a hammock 1 comprising a plurality of elongated biconvex fabric panels 3 that are sewn together along their adjoining edges 33 to form a bed 2. Outer support straps 6 capable of bearing high mechanical load are attached to the outer longitudinal edges 34 of the two outer fabric panels 31,32 (preferably by sewing), in order to impart a high degree of stability to the hammock 1.

The outer support straps 6 preferably extend several centimeters beyond the two ends of the hammock in order to form a loop, by which the hammock 1 can be attached to anchor elements 5 by means of suspension elements 4 (preferably ropes).

In addition, all seams of the individual fabric panels 3 are preferably also reinforced at the ends 8 of the hammock with (narrow) inner support straps 7 in order to define the shape of the bed 2. The inner support straps 7 may also function as additional suspension elements 4 and/or may form attachment loops.

The inner support straps 7 on the inner fabric panels 3 may be provided in end sections 8 of the hammock 1 and need not extend along the entire length of the fabric panels 3 in the longitudinal extension of the hammock 1. This has the advantage that a user does not recline on the inner support straps 7, but only on the fabric panels 3, which improves the comfort provided by the hammock 1.

Figure 3:
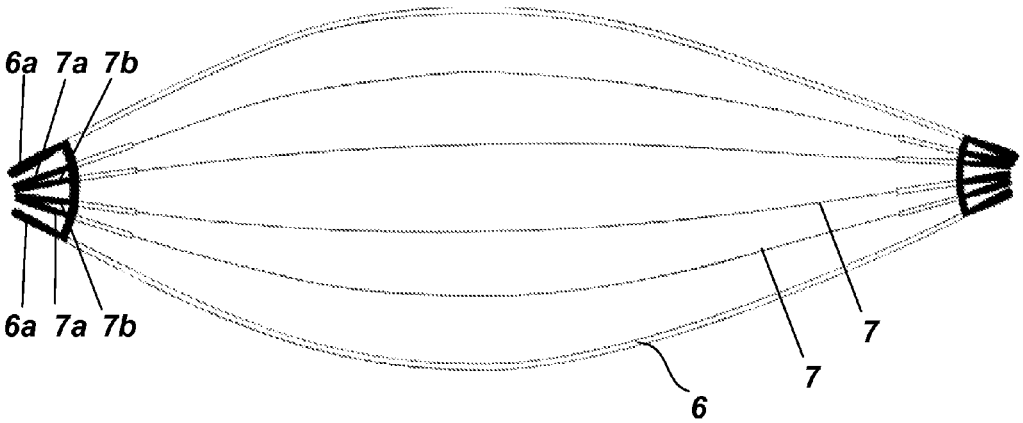
FIG. 3 is a schematic top view showing a hammock with support straps of different lengths.

Referring now to FIG. 3, the end portions 7*a*, 7*b* of the inner support straps 7 and the end portion 6*a* of the outer support straps 6 which extend axially beyond the fabric panels 3 of the hammock 1 may be of different lengths. The end portion of a support strap here refers to that part of a support strap that extends axially outwardly of the fabric panel 3. The end portions of the support straps may become successively shorter with the end portions 6*a* of the outer support straps 6 being the longest, and the end portions 7*b* of the innermost support straps 7 being the shortest. For example, the end portions 6*a* of the outer support straps 6 may be 10 cm long. The end portions 7*a* of the inner support straps 7 which are adjacent to the outer support straps 6 may be 9 cm long. Finally, the end portions 7*b* of the innermost support straps 7 may be 8 cm long. The end portions 6*a*, 7*a*, 7*b* may be formed as attachment loops through which an attachment rope can be lead. The different lengths of the end sections 6*a*, 7*a*, 7*b* of the inner and outer support straps 6, 7 causes a pretensioning of the hammock with a laterally extended bed 2. Due to the pretensioning of the end sections 6*a*, 7*a*, 7*b* the hammock 1 sags less than traditional hammocks without spreader bar, allowing the hammock 1 to be mounted lower without touching the ground. The pretensioned end sections 6*a*, 7*a*, 7*b* causes the hammock 1 to be stiffer and less prone to wrapping around a user upon entering the hammock than traditional hammocks without spreader bars.

The biconvex shape of fabric panels 3 provides an open, laterally extended, bed 2 when the hammock 1 is suspended from its anchors elements 5 without the need for a spreader bar. The fabric panels 3 are preferably made of all-weather material that ensures that the hammock 1 can be exposed to the elements year-round. Furthermore, due to the special quality of the micromesh fabric, it is also not sensitive to sun, UV light, salt, or seawater, and is comfortable against the skin.

Through the invention of the non-spreader bar all-weather hammock, potential spheres of application are opened that were previously greatly limited by the available cotton/cloth hammocks. These spheres of application are, in particular, the public sphere in areas of high user traffic, which places great demands on the stability, ease of maintenance, and hygienic qualities of the hammock; but also areas in the vicinity of salt/seawater, such as on yachts and ships which are constantly exposed to the sun and the sea. Particularly in areas in which space is limited, the hammock 1 in accordance with the invention offers significant advantages in terms of placement, installation, and use.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

What is claimed is:

1. A hammock, comprising:

a bed formed by a plurality of elongated biconvex fabric panels arranged next to each other in a longitudinal extension of the hammock;

outer support straps extending along outer edges of the bed and inner support straps arranged along seams between the biconvex fabric panels, the outer support straps and the inner support straps comprising end sections which extend axially outwardly of the elongated biconvex fabric panels;

anchor elements provided at both ends of the hammock; and suspension elements connecting the anchor elements with the bed, wherein the elongated biconvex fabric panels are made of micromesh fabric and are joined to one another along their longitudinal edges, and wherein the end sections of the outer support straps are longer than the end sections of the inner support straps.

2. The hammock as in claim 1, wherein the outer support straps form a loop to which the suspension elements are attached.

3. The hammock as in claim 1, wherein the inner support straps reinforce the seams between joined biconvex fabric panels in end sections of the bed.

4. The hammock as in claim 3, wherein the inner support straps do not extend along the entire length of the bed.

5. The hammock as in claim 1, wherein the end sections of the inner support straps and the outer support straps are formed as loops.

* * * * *